US010877501B1

(12) United States Patent
Zhang et al.

(10) Patent No.: US 10,877,501 B1
(45) Date of Patent: Dec. 29, 2020

(54) POWER SUPPLY POWERING-ON STRUCTURE

(71) Applicant: Shanghai Huali Microelectronics Corporation, Shanghai (CN)

(72) Inventors: Ning Zhang, Shanghai (CN); Yifei Qian, Shanghai (CN)

(73) Assignee: Shanghai Huali Microelectronics Corporation, Shanghai (CN)

( * ) Notice: Subject to any disclaimer, the term of this patent is extended or adjusted under 35 U.S.C. 154(b) by 0 days.

(21) Appl. No.: 16/822,757

(22) Filed: Mar. 18, 2020

(30) Foreign Application Priority Data

Jul. 17, 2019 (CN) ..... 2019 1 0643552

(51) Int. Cl.
*G05F 1/575* (2006.01)
*G05F 1/59* (2006.01)

(52) U.S. Cl.
CPC ..... *G05F 1/575* (2013.01); *G05F 1/59* (2013.01)

(58) Field of Classification Search
None
See application file for complete search history.

(56) References Cited

U.S. PATENT DOCUMENTS 6,175,223 B1 1/2001 Martinez et al.
7,288,926 B2 * 10/2007 Lee ..... G05F 1/465 323/314
7,466,115 B2 * 12/2008 Biagi ..... H03F 1/02 323/273
8,604,869 B1 * 12/2013 Ma ..... H02M 3/07 327/143
9,477,244 B2 * 10/2016 Luo ..... G05F 1/468
9,742,262 B1 * 8/2017 Jutras ..... H02M 1/36
2014/0253072 A1 9/2014 Hussien et al.

FOREIGN PATENT DOCUMENTS

CN 101568893 A 10/2009
CN 103440009 A 12/2013
CN 105786069 A 7/2016

OTHER PUBLICATIONS

Mar. 20, 2020—(CN) First Search Report Appn 2019106435527.

* cited by examiner

*Primary Examiner* — Jeffery S Zweizig
(74) *Attorney, Agent, or Firm* — Banner & Witcoff, Ltd.

(57) ABSTRACT

The present invention discloses a power supply powering-on structure, which comprises an LDO module, a bandgap reference module, a voltage detection module, a bias module and a switch module; the working voltage of the LDO module, the voltage detection module and the bias module adopts external power supply voltage; the working voltage of the bandgap reference module adopts LDO output voltage; the switch module provides switching connection between the output of the bias module and the output of the bandgap reference module for a reference voltage input end and a bias current input end of the LDO module. The present invention can adopt internal power supply voltage to supply power to the bandgap reference module and can also solve the problem that the internal power supply voltage restricts the powering-on and starting of the bandgap reference module.

15 Claims, 2 Drawing Sheets

POWER SUPPLY POWERING-ON STRUCTURE

CROSS REFERENCE TO RELATED APPLICATIONS

The present application claims priority to and the benefit of Chinese Patent Application No. 201910643552.7 filed on Jul. 17, 2019, the disclosure of which is incorporated herein by reference in its entirety as part of the present application.

BACKGROUND

The present invention relates to a semiconductor integrated circuit, in particular to a power supply powering-on structure.

In a common system, conventional modules such as a power supply will be directly supplied with power by an external power supply to ensure the stability of powering-on and the feature of constant turning-on. FIG. 1 is a structural diagram of an existing first-type power supply powering-on structure. A power supply module consisting of a bandgap reference module 203 and an LDO module 202 is directly connected to external power supply voltage VCC to form the existing first-type power supply powering-on structure 101*a*. The output of the LDO module 202 is used as the power supply voltage of a chip such as SOC 201, i.e., internal power supply voltage VDD_CORE. The LDO module 202 needs the input of reference voltage VREF and bias current IBIAS output from the bandgap reference module 203.

However, in a low-power-consumption design, the direct current to direct current (DCDC) with high efficiency is usually used to directly supply power to the system. In this way, the bandgap reference module 203 will directly face the ripple caused by DCDC. As an internal reference, the bandgap reference module 203 needs to provide clean and stable reference voltage and current. Therefore, in many systems, the power supply of the bandgap reference module 203 uses internal power supply voltage VDD_CORE generated by the internal LDO module 202, but a problem of powering-on and starting is caused at the same time. FIG. 2 is a structural diagram of an existing second-type power supply powering-on structure. A power supply end of the bandgap reference module 203 is connected to the internal power supply voltage VDD_CORE, the power end of the bandgap reference module 203 is no longer connected to the external power supply voltage VCC, and finally the existing second-type power supply powering-on structure 101*b* is formed. The existing second-type power supply powering-on structure 101*b* illustrated in FIG. 2 has the following contradiction: the LDO module 202 still needs the accurate reference voltage VREF and bias current IBIAS provided by the bandgap reference module 203, but the bandgap reference module 203 is capable of providing only after the LDO module 202 is started. This causes a contradiction that the LDO module 202 cannot be established if the bandgap reference module 203 is not established. As illustrated by reference sign 102 in FIG. 2, the LDO module 202 cannot be established.

The existing common SOC power supply solution usually adopts the existing first-type power supply powering-on structure illustrated in FIG. 1 to ensure the stability of the entire power supply system for powering-on the SOC. However, in the flash process platform, the bandgap reference module 203 formed by adopting 5V devices has the problem of large output variation, which cannot meet the system application need. Therefore, in order to meet the system application need, the existing second-type power supply powering-on structure illustrated in FIG. 2 is usually adopted, and the output of the LDO module 202 is used as the power supply voltage of the bandgap reference module 203, the internal power supply voltage VDD_CORE can be 1.2V, the bandgap reference module 203 using 1.2V internal power supply voltage VDD_CORE is more accurate and the variation is smaller, but problem of starting is also caused. The existing methods usually use a logic way to control starting, but the effect is not good.

BRIEF SUMMARY

The technical problem to be solved by the present invention is to provide a power supply powering-on structure, which can adopt internal power supply voltage to supply power to the bandgap reference module and can also solve the problem that the internal power supply voltage restricts the powering-on and starting of the bandgap reference module, thus realizing the excellent powering-on and starting of the entire power supply circuit.

In order to solve the above technical problem, the power supply powering-on structure provided by the present invention comprises an LDO module, a bandgap reference module, a voltage detection module, a bias module and a switch module.

An output end of the LDO module provides LDO output voltage.

The working voltage of the LDO module, the voltage detection module and the bias module adopts external power supply voltage.

The working voltage of the bandgap reference module adopts the LDO output voltage.

An input end of the LDO module comprises a reference voltage input end and a bias current input end.

An output end of the bias module provides first bias voltage and first bias current.

An output end of the bandgap reference module provides second reference voltage and second bias current.

The switch module has two connection states, the first connection state is that the reference voltage input end of the LDO module is connected to the first bias voltage and the bias current input end of the LDO module is connected to the first bias current, and the second connection state is that the reference voltage input end of the LDO module is connected to the second reference voltage and the bias current input end of the LDO module is connected to the second bias current An input end of the voltage detection module is connected to the LDO output voltage, an output end of the voltage detection module outputs a switching control signal to the switch module, and the switching control signal enables the switch module to be switched between the first connection state and the second connection state.

When powering-on is started, the switching control signal enables the switch module to be in the first connection state, the LDO output voltage rises gradually, and when the voltage detection module detects that the LDO output voltage rises to a value capable of enabling the bandgap reference module to work stably, the switching control signal enables the switch module to be switched to the second connection state.

As a further improvement, the LDO output voltage is provided to a system on chip as internal power supply voltage.

As a further improvement, the switch module comprises a first switch and a second switch.

Both the first switch and the second switch are one-out-of-two switches.

A first input end of the first switch is connected to the first bias voltage, a second input end of the first switch is connected to the second reference voltage, and an output end of the first switch is connected to the reference voltage input end of the LDO module.

A first input end of the second switch is connected to the first bias current, a second input end of the second switch is connected to the second bias current, and an output end of the second switch is connected to the bias current input end of the LDO module.

As a further improvement, when the LDO output voltage rises to more than 80% of a preset value corresponding to full start, the LDO output voltage is capable of enabling the bandgap reference module to work stably.

As a further improvement, when the LDO output voltage rises to 80%-90% of a preset value corresponding full start, the switching control signal enables the switch module to be switched to the second connection state.

As a further improvement, after powering-on is completed, the switch module is always kept in the second connection state.

As a further improvement, in a powering-on process, the value of the first bias current is kept unchanged.

As a further improvement, in the powering-on process, the first bias voltage rises gradually.

As a further improvement, the LDO module comprises a differential amplifier, a first PMOS transistor and a series resistor; a first input end of the differential amplifier is connected to the reference voltage input end, a second input end is connected to feedback voltage, an output end is connected to a gate of the first PMOS transistor, a source of the first PMOS transistor is connected to external power supply voltage, the series resistor is connected between a drain of the first PMOS transistor and the ground, the drain of the first PMOS transistor outputs the LDO output voltage, and the series resistor divides the LDO output voltage to obtain the feedback voltage.

The differential amplifier comprises tail current and a mirror path of the tail current, and an input end of the mirror path of the tail current is the bias current input end.

As a further improvement, the differential amplifier comprises a first active load and a second active load which are mirror images of each other.

As a further improvement, the body of the differential amplifier comprises a first NMOS transistor and a second NNOS transistor.

The first active load is connected between the drain of the first NMOS transistor and the external power supply voltage, and the second active load is connected between the drain of the second NMOS transistor and the external power supply voltage.

A source of the first NMOS transistor is connected to a source of the second NMOS transistor and is connected to the ground through the tail current.

As a further improvement, the first active load consists of a second PMOS transistor and the second active load consists of a third PMOS transistor.

As a further improvement, the tail current consists of a third NMOS transistor and the mirror path of the tail current consists of a fourth NMOS transistor.

As a further improvement, the switching control signal is also input to the bias module, the bias module works when powering-on is started, and the switching control signal enables the bias module to stop working when or after the switch module is switched to the second connection state.

As a further improvement, the system on chip is a single-power-supply system on chip.

In the power circuit of the present invention, the output of the LDO module, i.e., the LDO output voltage is adopted to supply power to the bandgap reference module. That is to say, the present invention can adopt internal power supply voltage to supply power to the bandgap reference module. Based on the power supply circuit, the present invention adds a voltage detection module, a bias module and a switch module to jointly form the power supply powering-on structure, and the working voltage of the bias module directly adopts external power supply voltage, so the bias module can provide reference voltage and bias current required for the starting to the LDO module in the powering-on and starting process, thus realizing the starting of the LDO module. Through the voltage detection module, the output voltage of LDO module can be detected. When it is detected that the LOD output voltage rises a value capable of enabling the bandgap reference module to work stably, the switch module is controlled to be switched to enable the bandgap reference module to replace the bias module to provide the reference voltage and bias current required for the starting to the LDO module, thus realizing the excellent powering-on and starting of the entire power supply circuit. Therefore, the present invention can adopt internal power supply voltage to supply power to the bandgap reference module and can also solve the problem that the internal power supply voltage restricts the powering-on and starting of the bandgap reference module, thus realizing the excellent powering-on and starting of the entire power supply circuit.

The bias module of the present invention can keep the value of the output first bias current unchanged and keep the first bias voltage to rise gradually in the powering-on process, thus realizing excellent soft start. The present invention can realize accurate switching through the detection by the voltage detection module and the control to the switch module, which can enable the powering-on of the power supply powering-on structure provided by the present invention to be very stable and safe, and avoid the situation of start failure or SOC damage caused by start overshoot in many designs.

BRIEF DESCRIPTION OF THE DRAWINGS

The present invention will be further described below in detail with reference to the drawings in combination with the specific embodiments.

DETAILED DESCRIPTION

Figure 1:
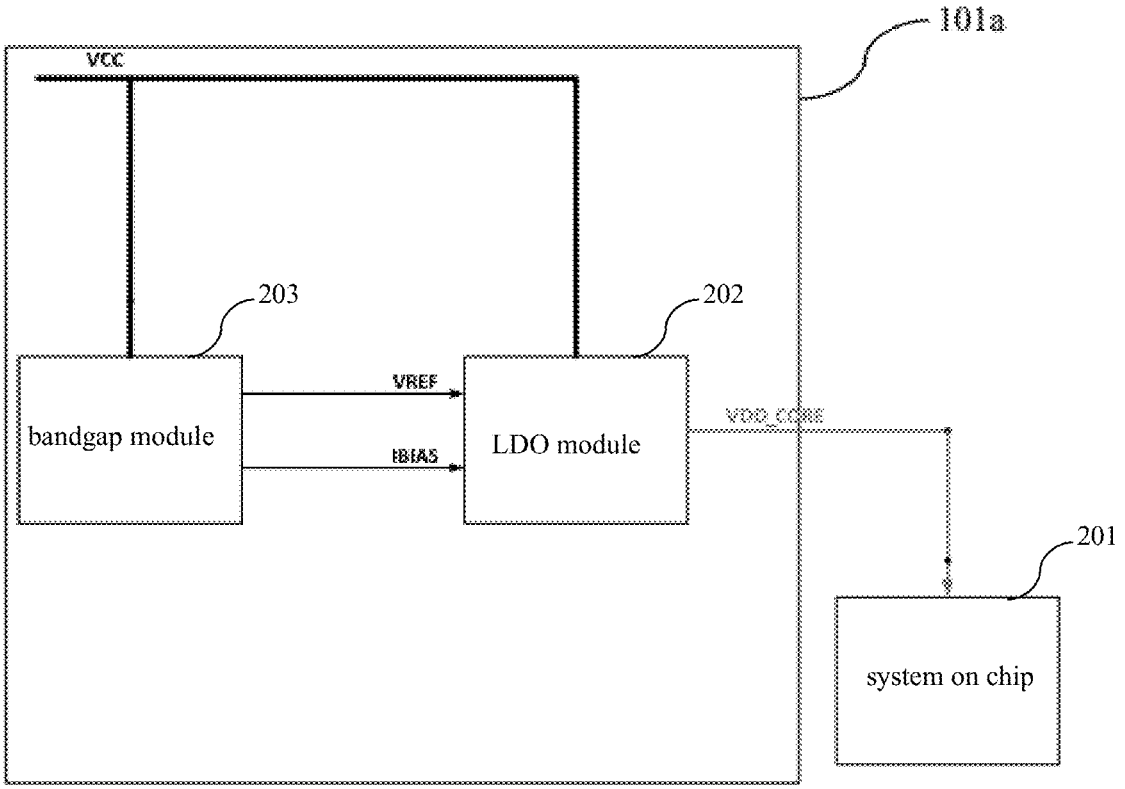
FIG. 1(Prior Art)
FIG. 1 is a structural diagram of an existing first-type power supply powering-on structure.
Figure 2:
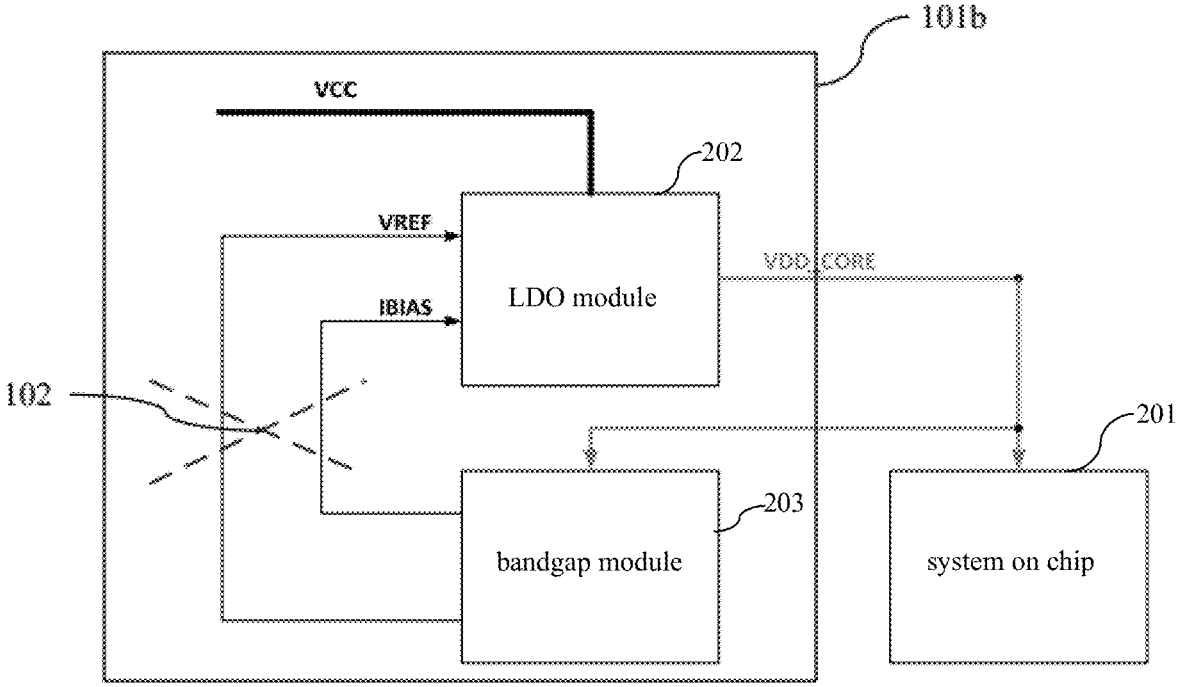
FIG. 2(Prior Art)
FIG. 2 is a structural diagram of an existing second-type power supply powering-on structure.
Figure 3:
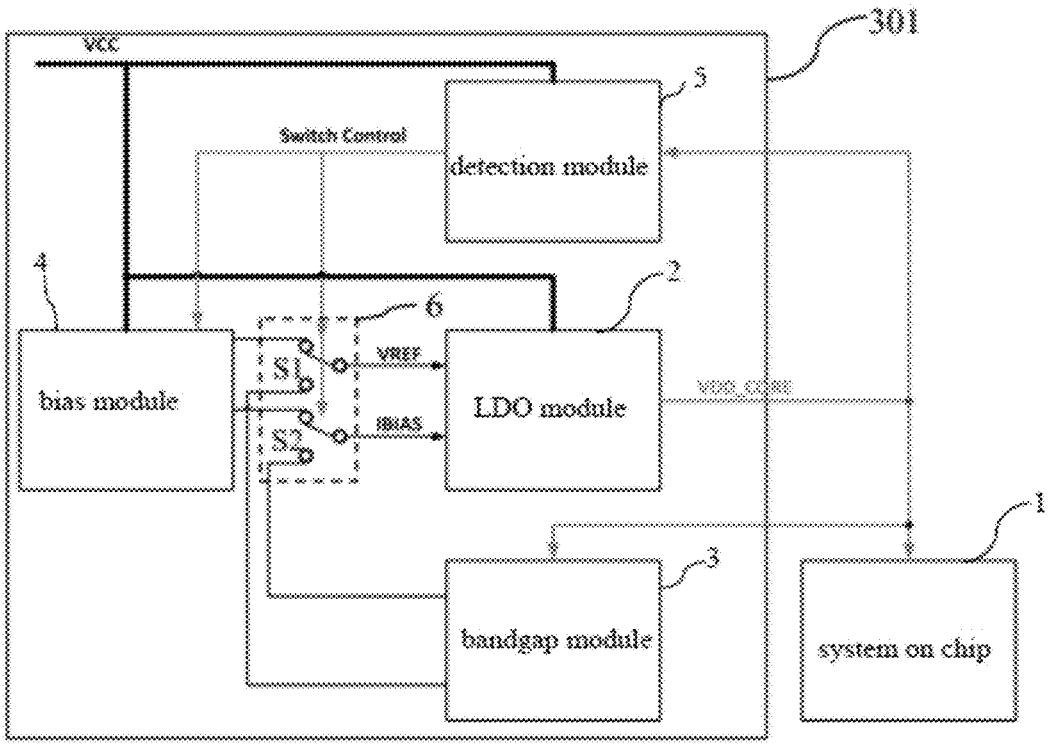
FIG. 3 is a structural diagram of a power supply powering-on structure according to one embodiment of the present invention.

As illustrated in FIG. 3 which is a structural diagram of a power supply powering-on structure 301 according to one embodiment of the present invention, the power supply powering-on structure 301 according to the embodiment of the present invention comprises an LDO module 2, a bandgap reference module 3, a voltage detection module 5, a bias module 4 and a switch module 6.

An output end of the LDO module 2 provides LDO output voltage VDD_CORE.

The working voltage of the LDO module 2, the voltage detection module 5 and the bias module 4 adopts external power supply voltage VCC.

The working voltage of the bandgap reference module 3 adopts the LDO output voltage VDD_CORE.

An input end of the LDO module 2 comprises a reference voltage input end VREF and a bias current input end IBIAS.

An output end of the bias module 4 provides first bias voltage and first bias current.

An output end of the bandgap reference module 3 provides second reference voltage and second bias current.

The switch module 6 has two connection states, the first connection state is that the reference voltage input end VREF of the LDO module 2 is connected to the first bias voltage and the bias current input end IBIAS of the LDO module 2 is connected to the first bias current, and the second connection state is that the reference voltage input end VREF of the LDO module 2 is connected to the second reference voltage and the bias current input end IBIAS of the LDO module 2 is connected to the second bias current.

An input end of the voltage detection module 5 is connected to the LDO output voltage VDD_CORE, an output end of the voltage detection module 5 outputs a switching control signal Switch Control to the switch module 6, and the switching control signal Switch Control enables the switch module 6 to be switched between the first connection state and the second connection state.

When powering-on is started, the switching control signal Switch Control enables the switch module 6 to be in the first connection state, the LDO output voltage VDD_CORE rises gradually, and when the voltage detection module 5 detects that the LDO output voltage VDD_CORE rises to a value capable of enabling the bandgap reference module 3 to work stably, the switching control signal Switch Control enables the switch module 6 to be switched to the second connection state.

The LDO output voltage VDD_CORE is provided to a system on chip 1 as internal power supply voltage. In the embodiment of the present invention, the system on chip 1 is a single-power-supply system on chip 1.

The switch module 6 comprises a first switch S1 and a second switch S2.

Both the first switch S1 and the second switch S2 are one-out-of-two switches.

A first input end of the first switch S1 is connected to the first bias voltage, a second input end of the first switch S1 is connected to the second reference voltage, and an output end of the first switch S1 is connected to the reference voltage input end VREF of the LDO module 2.

A first input end of the second switch S2 is connected to the first bias current, a second input end of the second switch S2 is connected to the second bias current, and an output end of the second switch S2 is connected to the bias current input end IBIAS of the LDO module 2.

In the embodiment of the present invention, when the LDO output voltage VDD_CORE rises to more than 80% of a preset value corresponding to full start, the LDO output voltage is capable of enabling the bandgap reference module 3 to work stably. When the LDO output voltage VDD_CORE rises to 80%-90% of a preset value corresponding full start, the switching control signal Switch Control enables the switch module 6 to be switched to the second connection state.

After powering-on is completed, the switch module 6 is always kept in the second connection state.

In a powering-on process, the value of the first bias current is kept unchanged. The first bias voltage rises gradually, thus realizing soft start.

The switching control signal Switch Control is also input to the bias module 4, the bias module 4 works when powering-on is started, and the switching control signal Switch Control enables the bias module 4 to stop working when or after the switch module 6 is switched to the second connection state.

Figure 4:
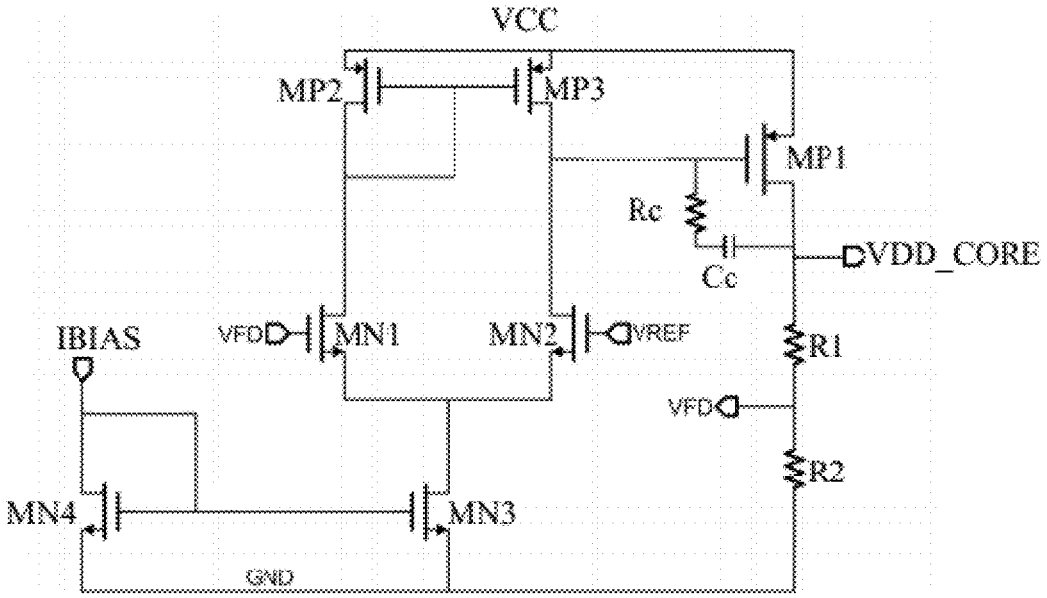
FIG. 4 is a circuit diagram of an LDO module adopted in FIG. 3.

As illustrated in FIG. 4 which is a circuit diagram of an LDO module adopted in FIG. 3. The LDO module 2 comprises a differential amplifier, a first PMOS transistor MP1 and a series resistor.

A first input end of the differential amplifier is connected to the reference voltage input end VREF, a second input end is connected to feedback voltage VFD, an output end is connected to a gate of the first PMOS transistor MP1, a source of the first PMOS transistor MP1 is connected to external power supply voltage VCC, the series resistor is connected between a drain of the first PMOS transistor MP1 and the ground GND, the drain of the first PMOS transistor MP1 outputs the LDO output voltage VDD_CORE, and the series resistor divides the LDO output voltage VDD_CORE to obtain the feedback voltage VFD. A compensation resistor Rc and a compensation capacitor Cc are further connected between the drain and the gate of the first PMOS transistor MP1. In FIG. 4, the series resistor is formed by a resistor R1 and a resistor R2 connected in series, and the feedback voltage VFD is formed at the connection of the resistor R1 and the resistor R2.

The differential amplifier comprises tail current and a mirror path of the tail current, and an input end of the mirror path of the tail current is the bias current input end IBIAS.

The body of the differential amplifier comprises a first NMOS transistor MN1 and a second NNOS transistor MN2.

The differential amplifier comprises a first active load and a second active load which are mirror images of each other. The first active load consists of a second PMOS transistor MP2 and the second active load consists of a third PMOS transistor MP3.

The first active load is connected between the drain of the first NMOS transistor MN1 and the external power supply voltage VCC, and the second active load is connected between the drain of the second NMOS transistor and the external power supply voltage VCC.

A source of the first NMOS transistor MN1 is connected to a source of the second NMOS transistor MN2 and is connected to the ground GND through the tail current.

The tail current consists of a third NMOS transistor MN3 and the mirror path of the tail current consists of a fourth NMOS transistor MN4.

In the power circuit of the embodiment of the present invention, the output of the LDO module 2, i.e., the LDO output voltage VDD_CORE is adopted to supply power to the bandgap reference module 3. That is to say, the present invention can adopt internal power supply voltage to supply power to the bandgap reference module 3. Based on the power supply circuit, the embodiment of the present invention adds a voltage detection module 5, a bias module 4 and a switch module 6 to jointly form the power supply powering-on structure 301, and the working voltage of the bias module 4 directly adopts external power supply voltage VCC, so the bias module 4 can provide reference voltage and bias current required for the starting to the LDO module 2 in the powering-on and starting process, thus realizing the starting of the LDO module 2. Through the voltage detection module 5, the output voltage of LDO module 2 can be detected. When it is detected that the LOD output voltage VDD_CORE rises a value capable of enabling the bandgap reference module 3 to work stably, the switch module 6 is controlled to be switched to enable the bandgap reference module 3 to replace the bias module 4 to provide the reference voltage and bias current required for the starting to the LDO module 2, thus realizing the excellent powering-on and starting of the entire power supply circuit. Therefore, the embodiment of the present invention can adopt internal power supply voltage to supply power to the bandgap reference module 3 and can also solve the problem that the internal power supply voltage restricts the powering-on and starting of the bandgap reference module 3, thus realizing the excellent powering-on and starting of the entire power supply circuit.

The bias module 4 of the embodiment of the present invention can keep the value of the output first bias current unchanged and keep the first bias voltage to rise gradually in the powering-on process, thus realizing excellent soft start. The present invention can realize accurate switching through the detection by the voltage detection module 5 and the control to the switch module 6, which can enable the powering-on of the power supply powering-on structure 301 provided by the embodiment of the present invention to be very stable and safe, and avoid the situation of start failure or SOC damage caused by start overshoot in many designs.

The present invention has been described above in detail through specific embodiments, but these embodiments do not constitute limitations to the present invention. Without departing from the principle of the present invention, one skilled in the art may also make many variations and improvements, which should also be regarded as included in the protection scope of the present invention.

What is claimed is:

1. A power supply powering-on structure, wherein the power supply powering-on structure comprises an LDO module, a bandgap reference module, a voltage detection module, a bias module and a switch module;

an output end of the LDO module provides LDO output voltage;

the working voltage of the LDO module, the voltage detection module and the bias module adopts external power supply voltage;

the working voltage of the bandgap reference module adopts the LDO output voltage;

an input end of the LDO module comprises a reference voltage input end and a bias current input end;

an output end of the bias module provides first bias voltage and first bias current;

an output end of the bandgap reference module provides second reference voltage and second bias current;

the switch module has two connection states, the first connection state is that the reference voltage input end of the LDO module is connected to the first bias voltage and the bias current input end of the LDO module is connected to the first bias current, and the second connection state is that the reference voltage input end of the LDO module is connected to the second reference voltage and the bias current input end of the LDO module is connected to the second bias current;

an input end of the voltage detection module is connected to the LDO output voltage, an output end of the voltage detection module outputs a switching control signal to the switch module, and the switching control signal enables the switch module to be switched between the first connection state and the second connection state;

when powering-on is started, the switching control signal enables the switch module to be in the first connection state, the LDO output voltage rises gradually, and when the voltage detection module detects that the LDO output voltage rises to a value capable of enabling the bandgap reference module to work stably, the switching control signal enables the switch module to be switched to the second connection state.

2. The power supply powering-on structure according to claim 1, wherein the LDO output voltage is provided to a system on chip as internal power supply voltage.

3. The power supply powering-on structure according to claim 1, wherein the switch module comprises a first switch and a second switch;

both the first switch and the second switch are one-out-of-two switches;

a first input end of the first switch is connected to the first bias voltage, a second input end of the first switch is connected to the second reference voltage, and an output end of the first switch is connected to the reference voltage input end of the LDO module;

a first input end of the second switch is connected to the first bias current, a second input end of the second switch is connected to the second bias current, and an output end of the second switch is connected to the bias current input end of the LDO module.

4. The power supply powering-on structure according to claim 1, wherein when the LDO output voltage rises to more than 80% of a preset value corresponding to full start, the LDO output voltage is capable of enabling the bandgap reference module to work stably.

5. The power supply powering-on structure according to claim 2, wherein when the LDO output voltage rises to 80%-90% of a preset value corresponding full start, the switching control signal enables the switch module to be switched to the second connection state.

6. The power supply powering-on structure according to claim 5, wherein after powering-on is completed, the switch module is always kept in the second connection state.

7. The power supply powering-on structure according to claim 1, wherein in a powering-on process, the value of the first bias current is kept unchanged.

8. The power supply powering-on structure according to claim 7, wherein in the powering-on process, the first bias voltage rises gradually.

9. The power supply powering-on structure according to claim 1, wherein the LDO module comprises a differential amplifier, a first PMOS transistor and a series resistor; a first input end of the differential amplifier is connected to the reference voltage input end, a second input end is connected to feedback voltage, an output end is connected to a gate of the first PMOS transistor, a source of the first PMOS transistor is connected to external power supply voltage, the series resistor is connected between a drain of the first PMOS transistor and the ground, the drain of the first PMOS transistor outputs the LDO output voltage, and the series resistor divides the LDO output voltage to obtain the feedback voltage;

the differential amplifier comprises tail current and a mirror path of the tail current, and an input end of the mirror path of the tail current is the bias current input end.

10. The power supply powering-on structure according to claim 9, wherein the differential amplifier comprises a first active load and a second active load which are mirror images of each other.

11. The power supply powering-on structure according to claim 10, wherein the body of the differential amplifier comprises a first NMOS transistor and a second NNOS transistor;

the first active load is connected between the drain of the first NMOS transistor and the external power supply voltage, and the second active load is connected between the drain of the second NMOS transistor and the external power supply voltage;

a source of the first NMOS transistor is connected to a source of the second NMOS transistor and is connected to the ground through the tail current.

12. The power supply powering-on structure according to claim 11, wherein the first active load consists of a second PMOS transistor and the second active load consists of a third PMOS transistor.

13. The power supply powering-on structure according to claim 12, wherein the tail current consists of a third NMOS transistor and the mirror path of the tail current consists of a fourth NMOS transistor.

14. The power supply powering-on structure according to claim 1, wherein the switching control signal is also input to the bias module, the bias module works when powering-on is started, and the switching control signal enables the bias module to stop working when or after the switch module is switched to the second connection state.

15. The power supply powering-on structure according to claim 2, wherein the system on chip is a single-power-supply system on chip.

* * * * *